United States Patent [19]

Feola

[11] 4,398,489

[45] Aug. 16, 1983

[54] BUILT-IN TRAILER FOR BOATS

[76] Inventor: Salvatore Feola, 2 N. Robert Damn St., Bethpage, N.Y. 11714

[21] Appl. No.: 338,894

[22] Filed: Jan. 12, 1982

[51] Int. Cl.[3] ..... B63C 13/00

[52] U.S. Cl. ..... 114/344; 280/414.5

[58] Field of Search ..... 280/43.2, 414 A, 414.5; 114/344; 244/102 R

[56] References Cited

U.S. PATENT DOCUMENTS

| | | | |
|---|---|---|---|
| 3,599,256 | 8/1971 | Carroll | 280/43.2 |
| 3,738,684 | 6/1973 | Lusk | 114/344 |
| 3,755,838 | 8/1973 | Dunagan | 114/244 |

*Primary Examiner*—Trygve M. Blix

*Assistant Examiner*—Jesus D. Sotelo

*Attorney, Agent, or Firm*—Michael I. Kroll

[57] ABSTRACT

A built-in trailer for boats is provided and consists of a boat having a pair of apertures at a medial point on the underside of the boat, a pair of retractable wheel assemblies mounted within the pair of apertures at the medial point on the underside of the boat and a stationary arm with one end mounted to the bow of the boat and the other end having a transverse aperture, a coupler arm with one end having a hollow cap to engage a hitch ball of a hitch on a motor vehicle to allow for horizontal movement and the other end having a transverse aperture and a pin is placed through the transverse aperture of the stationary arm and through the transverse aperture of the coupler arm to allow for vertical movement.

2 Claims, 7 Drawing Figures

BUILT-IN TRAILER FOR BOATS

BACKGROUND OF THE INVENTION

1. Field of the Invention

The instant invention relates generally to boats and more specifically it relates to a built-in trailer for boats.

2. Description of the Prior Art

All of the different kinds of trailers now available to boatmen are patterned on one of the three basic types: a fixed-frame trailer, a tilt-bed model and a hybrid with fixed bed and pivoting roller arms. Each, in its way, includes the essentials for trailering and launching a boat: a wheeled platform, special supports for the hull, and equipment to help the boatmen get his craft into the water and back out onto the trailer again. All have frames usually built of steel tubes or girders and from the frame rise wooden supports, padded to protect the boat's hull, or metal supporting arms fitted with tough rubber rollers to aid in sliding the boat off and into the water and back onto the trailer.

SUMMARY OF THE INVENTION

The instant invention offers a substantial improvement over the prior art as more fully described hereinafter.

A principle object of the present invention is to provide a built-in trailer for boats that will do away with the need for a separate trailer to transport boats.

Another object is to provide a built-in trailer for boats that eliminates the need for using more than one person to place the boat on the trailer and into the water.

An additional object is to provide a built-in trailer for boats that is more economical in cost than purchasing a separate trailer.

A further object is to provide a built-in trailer for boats that does not have to be placed in storage when not in use.

A still further object is to provide a built-in trailer that is easy to use.

Further objects of the invention will appear as the description proceeds.

DESCRIPTION OF THE PREFERRED EMBODIMENTS

Figure 1:
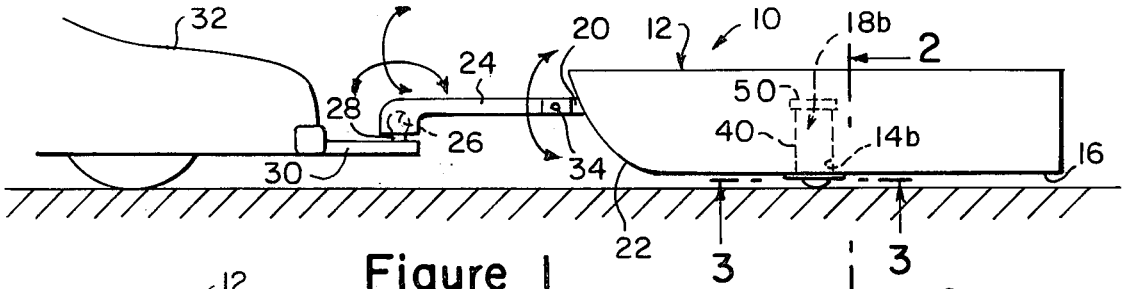
FIG. 1 is a side view of the invention in use.

Turning now descriptively to the drawings, in which similar elements throughout the several views, FIG. 1 illustrates the built-in trailer for boats 10. The invention consists of a boat 12 having a pair of apertures 14*a* and 14*b* at a medial point on the underside 16 of the boat 12. A pair of retractable wheel assemblies 18*a* and 18*b* are mounted with the pair of apertures 14*a* and 14*b* at the medial point on the underside 16 of the boat 12.

A stationary arm 20 has one end mounted to the bow 22 of the boat 12 and the other end has a transverse aperture. A coupler arm 24 has one end with a hollow cap 26 to engage a hitch ball 28 to a hitch 30 on a motor vehicle 32 to allow for horizontal movement and the other end having a transverse aperture. A pin 34 is placed through the transverse aperture of the stationary arm 20 and through the transverse aperture of the coupler arm 24 to allow for vertical movement.

Figure 2:
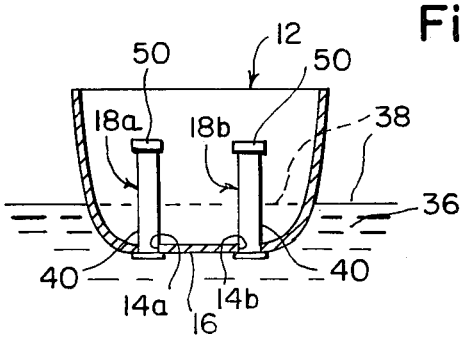
FIG. 2 is a cross sectional view of the boat taken along line 2—2 in FIG. 1.
Figure 3:
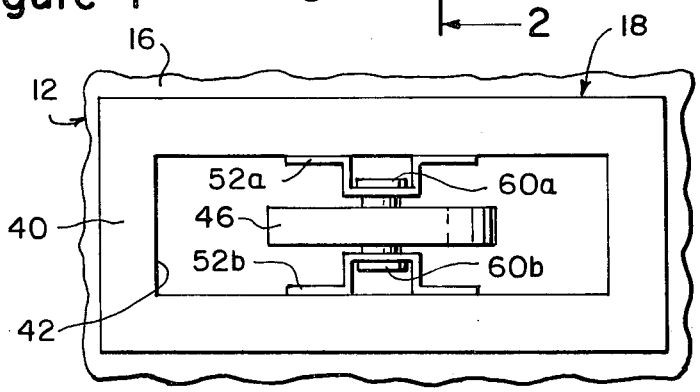
FIG. 3 is a bottom view of one of the retractable wheel assemblies taken along line 3—3 in FIG. 1.
Figure 7:
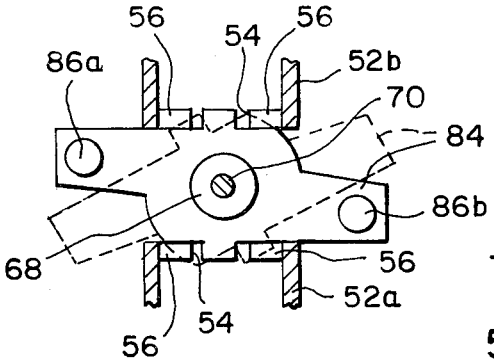
FIG. 7 is a cross sectional view taken along line 7—7 in FIG. 6.
Figure 4:
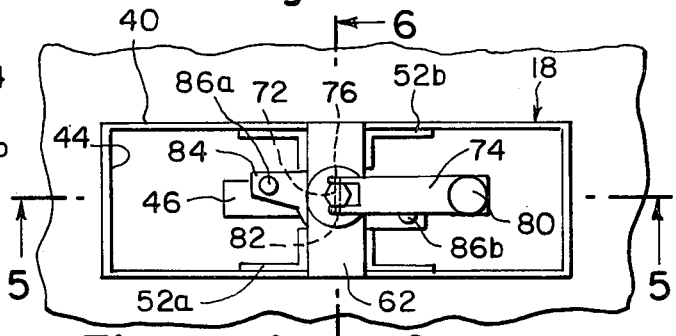
FIG. 4 is a top view of one of the retractable wheel assemblies.
Figure 6:
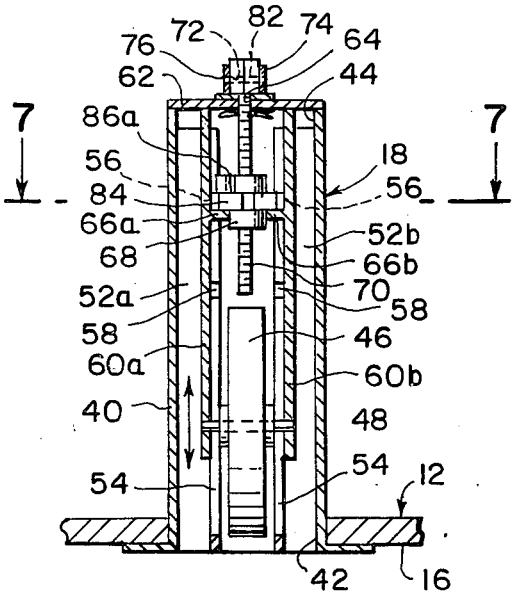
FIG. 6 is a cross sectional view of one of the retractable wheel assemblies taken along line 6—6 in FIG. 4.
Figure 5:
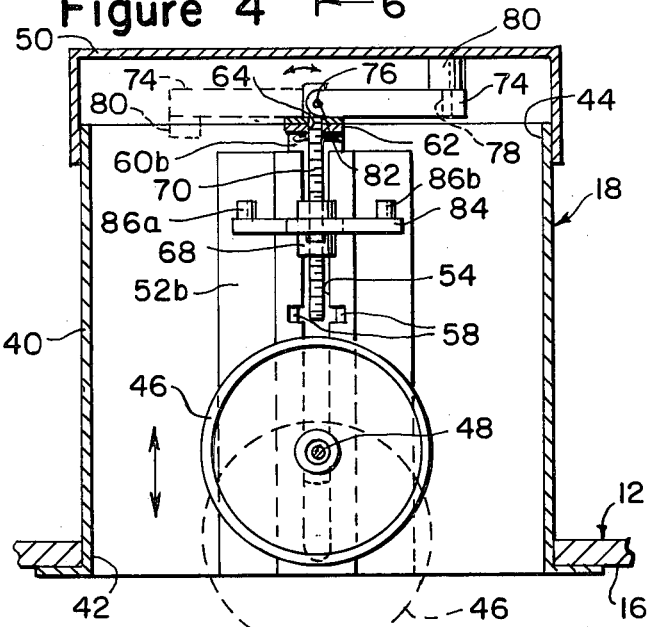
FIG. 5 is a cross sectional view of one of the retractable wheel assemblies taken along line 5—5 in FIG. 4.

FIG. 2 shows the boat 12 in the water 36. Since the retractable wheel assemblies 18*a* and 18*b* are higher than the water level 38 no water will enter the boat.

FIGS. 3 to 7 show one of the wheel assemblies 18 in greater detail. A housing 40 is provided having a bottom aperture 42 and a top aperture 44. A wheel 46 with axle 48 is slidably mounted within the bottom aperture 42 of the housing 40. A watertight cover 50 fits over the top aperture 44 of the housing 40.

A pair of tracks 52*a* and 52*b* each have an elongated vertical slot 54, a set of short horizontal transverse top slots 56 and a set of short horizontal transverse bottom slots 58. The tracks 52*a* and 52*b* are mounted vertically within the housing 40. A pair of arms 60*a* and 60*b* are each slidably placed vertically within each of the tracks 52*a* and 52*b* each of the arms 60*a* and 60*b* engaging the axle 48 of the wheel 46.

An upper cross brace 62 has a central aperture 64 and is affixed across the top aperture 44 of the housing 40. A pair of lower cross braces 66*a* and 66*b* are affixed at one end to each arm 60*a* and 60*b*. A threaded boss 68 is affixed between the other ends of the pair of lower cross braces 66*a* and 66*b*.

A threaded shaft 70 having a transverse aperture 72 in its upper end fits into the central aperture 64 of the upper cross brace 62 and threads into the threaded boss 68.

A handle 74 has a horizontal aperture 76 at a forked end and a vertical aperture 78 at the other end. A knob 80 is affixed into the vertical aperture 78 of the handle 74. The forked end is placed over the threaded shaft 70 and a pin 82 is placed through the horizontal aperture 76 of the handle 74 and into the transverse aperture 72 in the threaded shaft 70 allowing the handle 72 to rotate and pivot around the threaded shaft 70.

A locking arm 84 is pivotly affixed to the threaded boss 68 whereby when the locking arm 84 is in a vertical position with the set of short horizontal transverse top slots 56 the locking arm 84 can pivot and lock into the set of short horizontal transverse top slots 56 preventing the wheel 46 from moving down. When the locking arm 84 is in a vertical position with the set of short horizontal transverse bottom slots 58 the locking arm 84 can pivot and lock into the set of horizontal transverse bottom slots 58 preventing the wheel 46 from moving up. The locking arm 84 is provided with a pair of knobs 86*a* and 86*b* to aid in turning the locking arm 84.

While the form of apparatus herein described constitutes a preferred embodiment of the invention, it is understood that the invention is not limited to this precise form of apparatus and that changes may be made therein without departing from the scope of this invention.

Having regard to the foregoing disclosure the following is claimed as the inventive and patentable embodiments thereof:

1. A built-in trailer for boats which comprises:

(a) a boat having a pair of apertures at a medial point on the underside of said boat;

(b) a pair of retractable wheel assemblies mounted within said pair of apertures at said medial points on said underside of said boat wherein each of said retractable wheel assembly comprises a housing having a bottom aperture and a top aperture, a wheel with axle slidably mounted within said bottom aperture of said housing, a means for raising and lowering said wheel comprising a pair of tracks each having an elongated vertical slot, a set of short horizontal transverse top slots and a set of short horizontal transverse bottom slots said tracks mounted vertically within said housing, a pair of arms each slidably placed within each of said tracks each arm engaging said axle of said wheel, a means for raising and lowering and locking said pair of arms and a watertight cover that fits over said top aperture of said housing; and (c) a means for coupling said boat to a hitch on a motor vehicle comprising a stationary arm with one end mounted to the bow of said boat and the other end having a transverse aperture, a coupler arm with one end having a hollow cap to engage a hitch ball of said hitch on said motor vehicle to allow the horizontal movement and the other end having a transverse aperture, and a pin placed through said transverse aperture of said stationary arm and through said transverse aperture of said coupler arm to allow for vertical movement.

2. A built-in trailer for boats as recited in claim 1, wherein said means for raising, lowering and locking said pair of arms comprises:

(a) an upper cross brace having a central aperture and affixed across said top aperture of said housing;

(b) a pair of lower cross braces each affixed at one end to each said arm;

(c) a threaded boss affixed between other ends of said pair of lower cross braces;

(d) a threaded shaft having an aperture in its upper end that fits into said central aperture of said upper cross brace and threads into said threaded boss;

(e) a handle having a horizontal aperture at forked end and a vertical aperture at the other end;

(f) a knob affixed into said vertical aperture of said handle;

(g) a pin placed through said horizontal aperture of said handle and into said transverse aperture in said threaded shaft allowing said handle to rotate and pivot around said threaded shaft; and (h) a locking arm pivotly affixed to said threaded boss whereby when said locking arm is in vertical position with said set of short horizontal transverse top slots said locking arm can pivot and lock into said set of short horizontal transverse top slots preventing said wheel from moving down and when said locking arm is in vertical position with said set of short horizontal transverse bottom slots said locking arm can pivot and lock into said set of short horizontal transverse bottom slots preventing said wheel from moving up.

* * * * *